US008499693B2

(12) United States Patent
Sullivan et al.

(10) Patent No.: US 8,499,693 B2
(45) Date of Patent: Aug. 6, 2013

(54) METHOD AND APPARATUS FOR OPTICALLY PROGRAMMING A PROJECTILE

(75) Inventors: Kevin Michael Sullivan, Kennebunk, ME (US); Jacob Stefanus Budricks, Alberton (ZA)

(73) Assignee: Rheinmetall Waffe Munition GmbH, Unterluess (DE)

( * ) Notice: Subject to any disclaimer, the term of this patent is extended or adjusted under 35 U.S.C. 154(b) by 582 days.

(21) Appl. No.: 12/284,219

(22) Filed: Sep. 19, 2008

(65) Prior Publication Data

US 2012/0298003 A1 Nov. 29, 2012

(51) Int. Cl.
*F42C 13/02* (2006.01)

(52) U.S. Cl.
USPC ..... 102/213; 102/215

(58) Field of Classification Search
USPC ..... 102/213, 215, 201
See application file for complete search history.

(56) References Cited

U.S. PATENT DOCUMENTS

| | | | | | |
|---|---|---|---|---|---|
| 3,329,952 | A | * | 7/1967 | Bogle | 102/214 |
| 3,698,811 | A | * | 10/1972 | Weil | 244/3.13 |
| 3,741,111 | A | * | 6/1973 | Brenner | 102/213 |
| 3,848,830 | A | * | 11/1974 | Born | 244/3.16 |
| 3,860,199 | A | * | 1/1975 | Dunne | 244/3.13 |
| 3,995,792 | A | * | 12/1976 | Otto et al. | 244/3.14 |
| 4,083,308 | A | * | 4/1978 | Levis | 102/215 |
| 4,096,380 | A | * | 6/1978 | Eichweber | 244/3.14 |
| 4,097,007 | A | * | 6/1978 | Fagan et al. | 244/3.14 |
| 4,269,121 | A | * | 5/1981 | Sochard | 102/213 |
| 4,406,430 | A | * | 9/1983 | Krammer et al. | 244/3.13 |
| 4,664,013 | A | * | 5/1987 | Wegner et al. | 102/215 |
| 5,102,065 | A | | 4/1992 | Courdec et al. | |
| 5,142,985 | A | * | 9/1992 | Stearns et al. | 102/213 |
| 5,196,644 | A | * | 3/1993 | Knight et al. | 102/213 |
| 5,247,866 | A | * | 9/1993 | O'Malley | 102/201 |
| 5,526,749 | A | * | 6/1996 | Teetzel | 102/213 |
| 6,138,547 | A | | 10/2000 | Larsson et al. | |
| 6,170,377 | B1 | | 1/2001 | Larsson et al. | |
| 6,216,595 | B1 | | 4/2001 | Lamorlette et al. | |
| 6,349,652 | B1 | * | 2/2002 | Hepner et al. | 244/3.23 |
| 6,880,467 | B1 | * | 4/2005 | Knapp | 102/513 |
| 7,174,835 | B1 | * | 2/2007 | Knapp | 102/513 |
| 2005/0126379 | A1 | | 6/2005 | Pikus et al. | |

FOREIGN PATENT DOCUMENTS

| | | | |
|---|---|---|---|
| GB | 2198815 | A * | 6/1988 |

* cited by examiner

*Primary Examiner* — Jonathan C Weber
(74) *Attorney, Agent, or Firm* — Muncy, Geissler, Olds & Lowe, PLLC

(57) ABSTRACT

A system for optically programming an in-flight projectile fired from a weapon comprises a fire control device and a controlled projectile. The fire control device comprises an optical transmitter and the projectile comprises a fuze, an optical collector and an optical sensor. The transmitter transmits optical signals to the in-flight projectile in order to program the circuit of the fuze disposed in the projectile.

31 Claims, 6 Drawing Sheets

METHOD AND APPARATUS FOR OPTICALLY PROGRAMMING A PROJECTILE

CROSS REFERENCE TO RELATED APPLICATIONS

This application claims priority of U.S. Provisional Application No. 60/994,774 filed on Sep. 21, 2007 under 35 U.S.C. §119(e), the entire contents of which are hereby incorporated by reference.

FIELD OF INVENTION

The invention in general relates to programming of an in-flight projectile fired from a fire control device and, more specifically, to the use of optically modulated signals for programming of the projectile.

BACKGROUND OF INVENTION

Existing methods for programming in-flight projectiles have distinct drawbacks. The disadvantage of using the 'Oerlikon AHEAD' technique is that it consumes a great deal of power. The programming coils used in this system are bulky and heavy. The use of radio frequency (RF) to transmit the programming signals ('NAMMO' radio frequency) is subject to interference from IED suppression technology. BOFORS Larson Patents limited use of this technology to closed bolt designs.

U.S. Patent Pub. No. 2005/0126379 discloses RF data communication link for setting electronic fuzes. Whereas the programming of the projectile is only limited to pre-launch programming. It does not provide any method to program an in-flight projectile.

U.S. Pat. No. 5,102,065 discloses a system to correct the trajectory of a projectile. It transmits corrections signal via a laser beam. The corrections are transmitted to the shell and the shell receives the information and applies it in order to deflect its trajectory. However, the use of self guided shells is very expensive and can only be used for the destruction of even costlier targets. Also U.S. Pat. No. 4,406,430 discloses an optical remote control arrangement for a self guided projectile. The remote control disclosed helps the projectile in hitting its desired target by modifying the trajectory of the projectile. Programming of the projectiles which are not self guided is not discussed in both of the patents.

U.S. Pat. No. 6,216,595 discloses a process for the in-flight programming of the trigger time for a projectile element. The trigger time is transmitted via radio frequency signals. The use of radio frequency adds several disadvantages to effective transmission such as interference from IED suppression technology.

U.S. Pat. No. 6,170,377 discloses a method and apparatus for transmission of programming data to a time fuze of a projectile via an inductive transmission coil. The inductive coils are very bulky and heavy.

U.S. Pat. No. 6,138,547 discloses a method and system for programming fuzes by using electric programming pulses to transmit data between a programmable fuze and a programming device.

In the systems disclosed in the above prior art, due to oscillation of the projectile, it is difficult to maintain consistent contact or proximity between the external source of the programmed pulses and the conductor located on the projectile. Also, both these methods require extensive modification of the weapon design which limits their use.

SUMMARY OF THE INVENTION

It is an object of the present invention to modulate the signal of a projectile with a set of instructions.

It is another object of the invention to allow for transmission of modulated optical signals to projectiles from a transmitter associated with a weapon.

It is still another object of the invention to program a fuze circuit by using the modulated optical signal.

The invention comprises a fire control device fitted with an optical transmitter to transmit a modulated optical signal, and a projectile fitted with a translucent housing (collector) for collecting the modulated optical signals, a fuze and an optical sensor.

The optical transmitter emits programming signals in the direction of the projectile (in-flight) with an adequate beam width and strength.

The optical light is modulated in amplitude to create an optical signal. Normally, the programming signal would include identification of a function mode and, as appropriate, an optimum function time. A logarithmic input allows the fuze electronics to distinguish the modulated signal input from other optical rays.

After transmission, the optical beam is collected by a translucent collector, mounted on the projectile. The collector refracts, and/or reflects and focuses the collected modulated optical signal to the optical sensor. The sensor becomes energized upon receiving the modulated optical signals. The energized sensor modulates the fuze circuit.

The foregoing and other objects, features and advantages of the invention will be apparent from the following more particular description of the invention, as illustrated in the accompanying drawings.

BRIEF DESCRIPTION OF DRAWINGS

Embodiments of the present invention, hereinafter described in conjunction with the appended drawings, are provided to illustrate and not to limit the present invention, wherein like designations denote like elements, and in which:

FIG. 2, comprising

FIG. 3, comprising

FIG. 4, comprising

DETAILED DESCRIPTION OF THE PREFERRED EMBODIMENTS

Embodiments of the present invention provide method and system for optically programming an in-flight projectile 40. In the description of the present invention, numerous specific details are provided, such as examples of components and/or mechanisms, to provide a thorough understanding of the various embodiments of the present invention. One skilled in the relevant art will recognize, however, that an embodiment of the present invention can be +practiced without one or more of the specific details, or with other apparatus, systems, assemblies, methods, components, materials, parts, and/or the like. In other instances, well-known structures, materials, or operations are not specifically shown or described in detail to avoid obscuring aspects of embodiments of the present invention.

Figure 1:
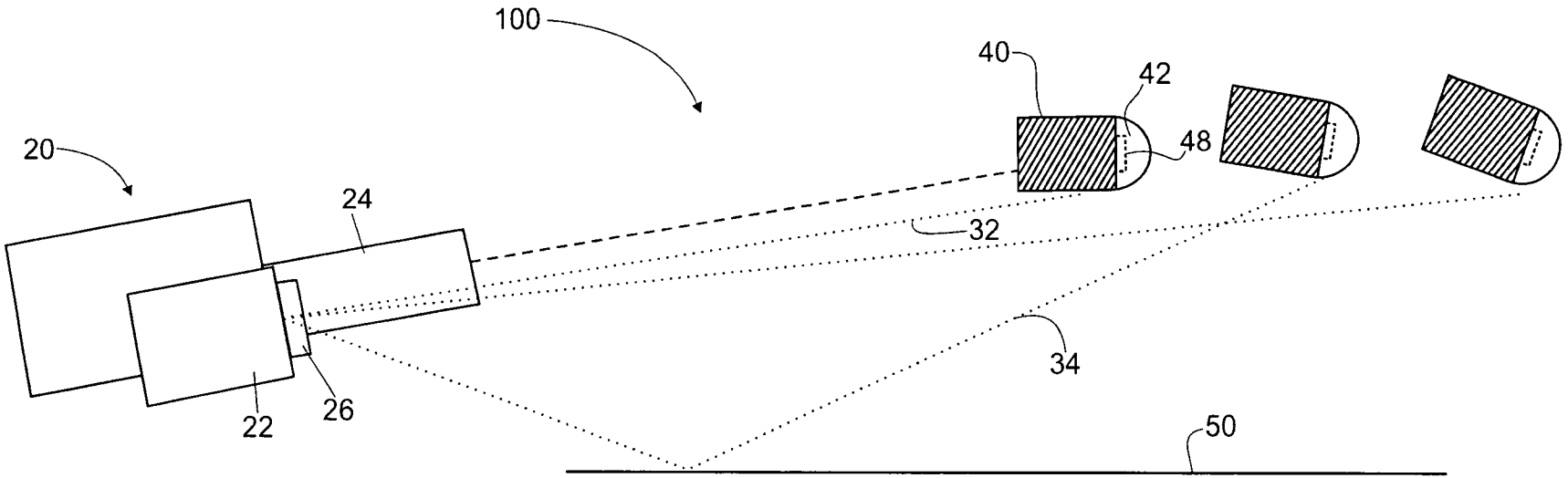
FIG. 1 depicts a weapon for firing a projectile and a fire control device 22 for transmission of optical signals to the in-flight projectile 40.
Figure 2A:
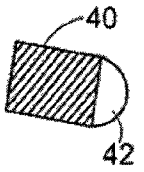
FIGS. 2*a*-2*d*, depicts reception of the optical signals (32, 34) by the in-flight projectile 40.
Figure 2B:
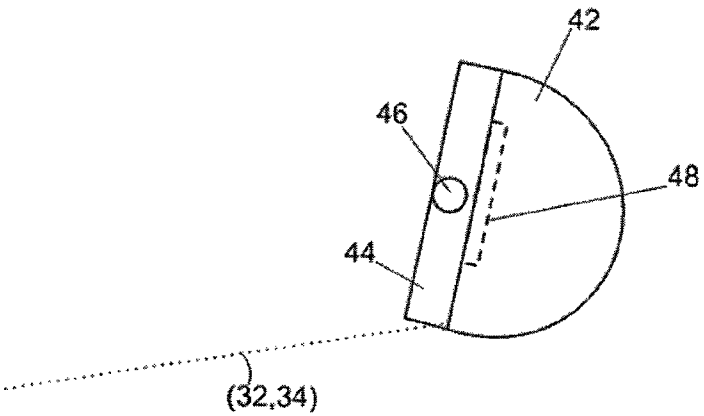
Figure 2C:
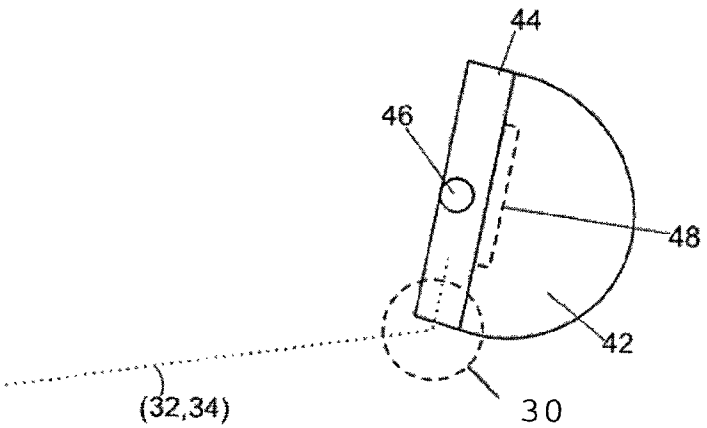
Figure 2D:
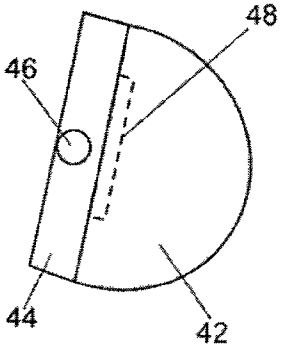

FIG. 1 illustrates a weaponry system 100 comprising a weapon (firing mechanism) 20, fire control device 22 for firing a projectile 40. The fire control device 22 includes an optical transmitter 26. The weapon 20 fires the projectile 40 while the transmitter 26 transmits optical signals (32, 34) to the in-flight projectile 40.

The weapon 20 can be a firearm, cannon, launcher, rocket pod or aircraft or the like. Many weapons include barrels 24.

Optical transmitter 26 is a light generating source comprising, for example, one or more light emitting diodes, laser beam sources and the like. The transmitter 26 can transmit optical signals (32, 34) of discrete frequencies in the UV, visual or IR spectrums.

In one embodiment of the invention the optical signals (32, 34) transmitted by the transmitter 26 to the projectile 40 are digital programming signals, which are modulated by the fire control device 20 to carry a set of instructions. The set of instructions are programming protocols. Normally, the programming signal would include a function mode and, as appropriate, an optimum function time.

The transmitter 26 can also send synchronizing signals along with the programming signals. The synchronizing signals carry information such as pre-determined time slot for which a fuze 48 (disposed in the projectile) should accept the input from the signals. After the time window is reached, the fuze 48 will no longer accept any signal. This helps in preventing the fuze 48 from interruption by any foreign signals (i.e. signals which are not sent by the transmitter 22 of the fire control device). This may also help in reducing the power consumption by the fuze 48.

FIG. 2 illustrates various components of the projectile 40 and their functionalities. The projectile 40 comprises a nose 42, a collector 44, one or more sensors 46 and an electronic fuze 48. The nose 42 is give shaped and incorporates the collector 44. The collector 44 has a translucent housing which protects the underlying sensor 46. Further, the sensor 46 is attached to the electronic fuze 48.

The modulated optical signals 30 are transmitted in the direction of the projectile 40 with an adequate beam width and strength so as to optimize the transmission. These transmitted modulated optical signals (32, 34) intersect the projectile 40 flight path allowing the signals to be collected by the collector 44 as illustrated in FIGS. 2(*b*) and 2(*c*). The collector 44 refracts, reflects and focuses the modulated optical signals (32, 34) to the sensor 46. The sensor 46 distinguishes the modulated optical signals (32, 34) from other signals to energize circuitry. The energized circuitry 46 uses logarithmic input response to modulate the electronic circuit of the fuze 48 which is illustrated in FIG. 2(*d*).

Figure 3A:
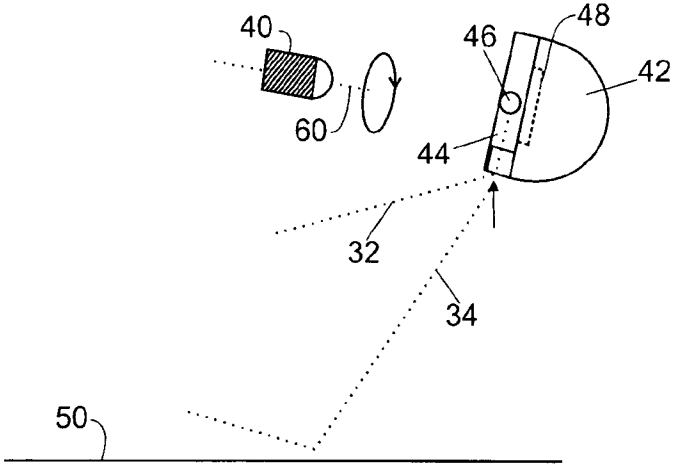
FIGS. 3*a* and 3*b*, depicts use of rotation to allow for efficient optical signal reception.
Figure 3B:
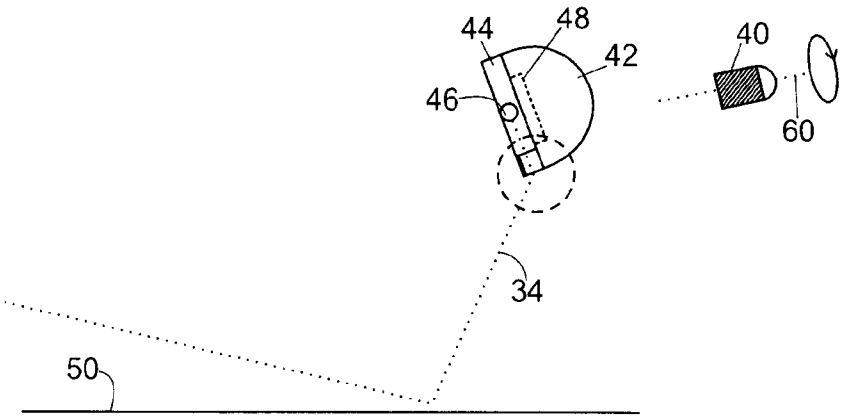

FIG. 3 illustrates varying degrees of rotation of the in-flight projectile 40 to position the projectile 40 to receive optical signals (32, 34) optimally. The rotation is induced by barrel lands and grooves acting on a driving band. FIG. 3 (*a*) shows an exploded view of the collector 44 position disposed in the nose 42 of the projectile 40 thereby enabling the collector 44 to receive direct optical signals 32 as well as reflected optical signals 34, reflected from intermediate surfaces 50. FIG. 3 (*b*) shows an exploded view of the position of the collector 44 receiving only reflected optical signals 34. In this position the angle of inclination of the axis of rotation 60 of the projectile 40 with respect to vertical plane is such that it does not allow the collector 44 to receive direct optical signals 32.

Figure 4A:
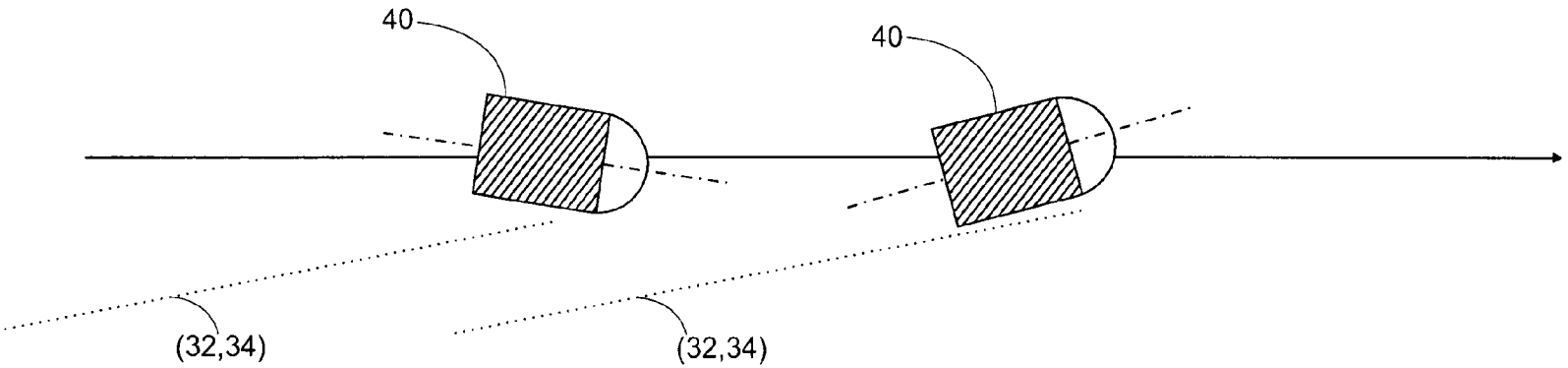
FIGS. 4*a* and 4*b*, depicts yaw cycle of an in-flight projectile 40.
Figure 4B:
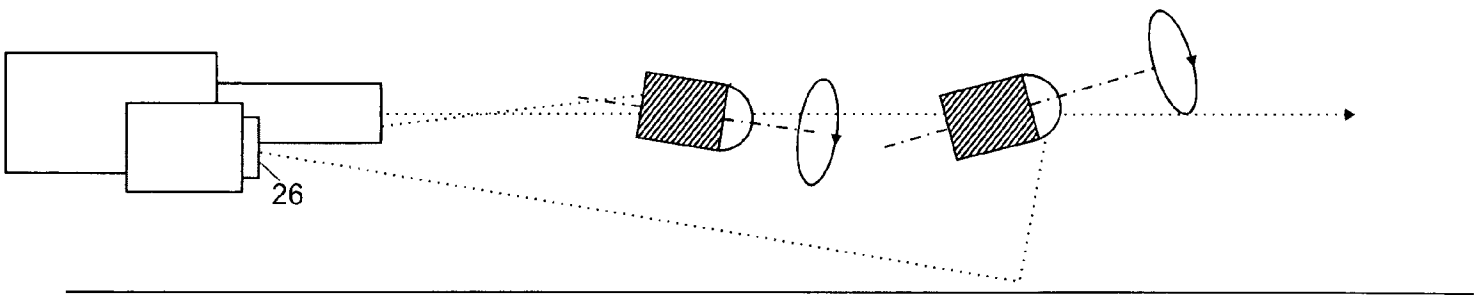

FIG. 4 illustrates a varying yaw cycle of the in-flight projectiles 40. FIG. 4(*a*) illustrates how yaw enables the projectile 40 to rotate about its vertical axis. Yaw can be induced on projectiles 40 through a number of well known mechanical factors. Yaw can position the projectile 40 to receive optical signals (32, 34) more effectively. FIG. 4(*b*) illustrates how the transmission of optical signals 30 is optimized with redundant signals. The transmitter 26 emits excessive optical signals to optimize reception. The induced rotation also provides for natural screening of sun's rays that can interfere with optical signal transmission. By incorporating redundant signals that are repeated at a rate that coincides with the rotation of the projectile, direct sun ray's can be screened allowing for improved signal processing.

Figure 5:
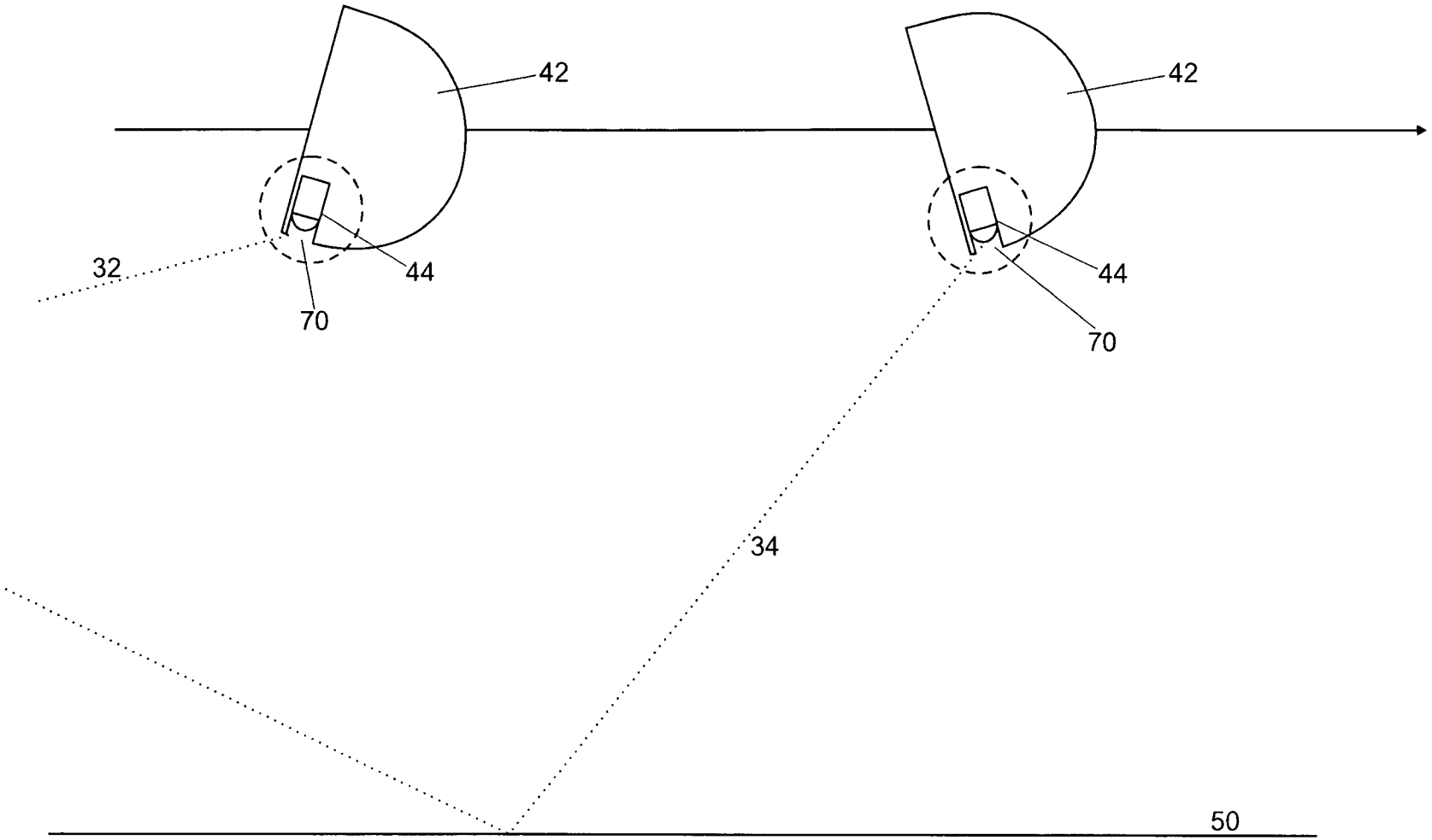
FIG. 5 depicts an alternate embodiment with a translucent lens 70 on the collector 44.

In an alternate embodiment of the invention as shown in FIG. 5, the collector 44 can be mounted at any position on the nose 42 of the projectile 40. The collector 44 can also incorporate translucent lens 70 to optimize collection of transmitted direct signal 32 and/or reflected signal 34.

Figure 6:
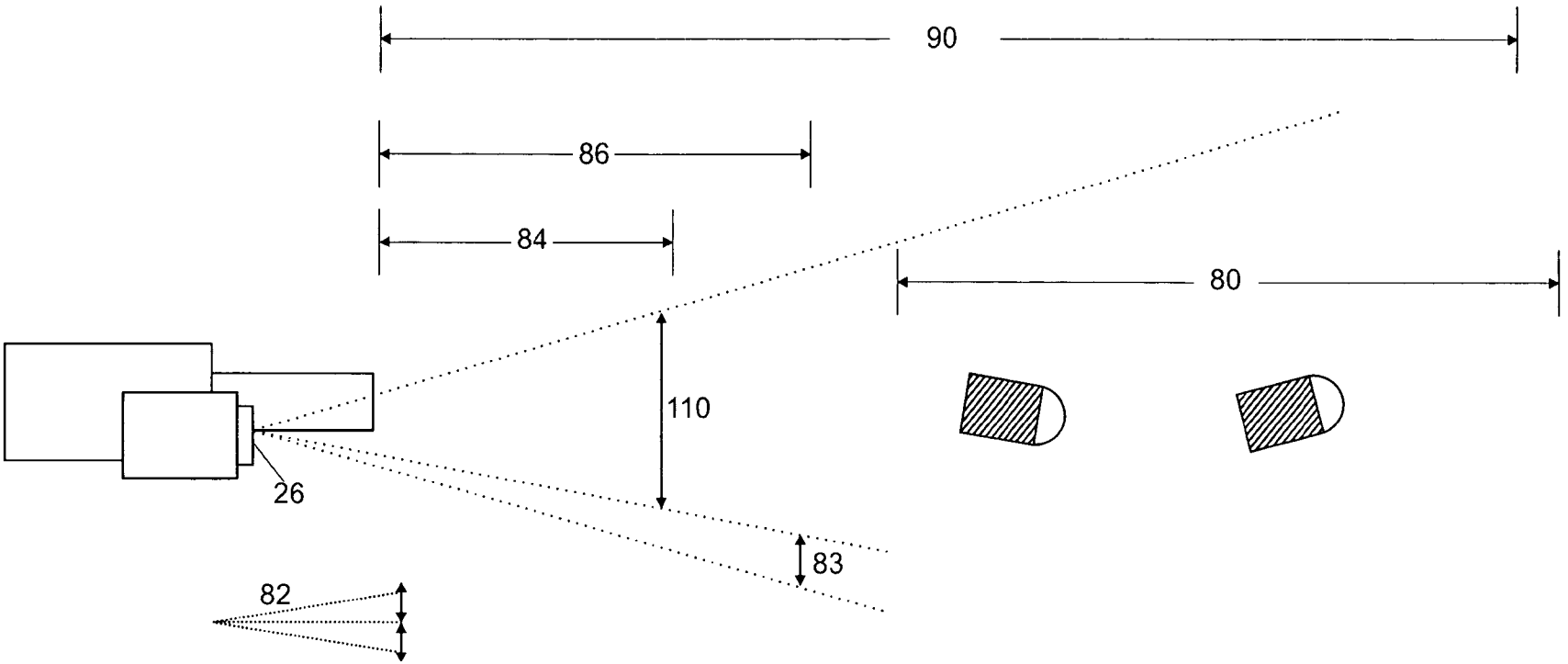
FIG. 6 depicts the convergence of modulated optical signals (32, 34) with the in-flight projectile 40.

As illustrated in FIG. 6, the transmitter 26 is focused and positioned to use geometric location position and beam divergence 110 to transmit light directly into the projectile path. FIG. 6 further illustrates the signal strength distance 90. Beyond this distance the intensity of the transmitter 26 diminishes and the intersection of the modulated optical signal and the in-flight projectile does not occur. The modulated optical signals intersect the projectile flight path for effective reception of the signal in the effective signal reception zone 80. This effective signal reception zone 80 can be varied by changing parameters such as signal strength and width. The transmission of the modulated optical signals depends on multiple factors such as post firing IR transmission resonance 82, gun jump and shock wave effect 83, muzzle flash and burnt powder residue zone 84, battery rise time 86 and projectile yaw frequency.

While embodiments of the present invention have been illustrated and described, it will be clear that the present invention is not limited to these embodiments only. Numerous modifications, changes, variations, substitutions and equivalents will be apparent to those skilled in the art, without departing from the spirit and scope of the present invention, as described in the claims.

What is claimed is:

1. A method for optically programming an in-flight projectile fired from a fire control device comprising the steps of:

a) transmitting modulated optical signals to said projectile from a transmitter attached to said fire control device;

b) collecting said modulated optical signals by a collector mounted on a nose of said projectile;

c) receiving said modulated optical signals from said collector by a sensor disposed within said projectile, wherein said modulated optical signals activate said sensor; and d) modulating a fuze circuit by said activated sensor, wherein transmitting modulated optical signals to said projectile comprises transmitting modulated optical signals directly to said projectile.

2. The method according to claim 1, wherein said modulated optical signals are transmitted at particular beam width, strength and frequency.

3. The method according to claim 1, wherein said transmitter and said sensor function at discrete frequencies in one of the UV, visual and IR spectrums.

4. The method according to claim 1, wherein said modulated optical signals are modulated in at least one of amplitude or frequency.

5. The method according to claim 1, wherein said modulated optical signals comprise a programming protocol including at least one of a function mode or an optimum function time.

6. The method according to claim 1, wherein said collector is made of translucent material.

7. The method according to claim 1, wherein said collector collects direct and reflected modulated optical signals from said transmitter.

8. The method according to claim 1, wherein said collector refracts, reflects and focuses said modulated optical signal to said sensor.

9. The method according to claim 1, wherein said fuze circuit uses a logarithmic input to distinguish said modulated optical signals from other optical rays.

10. The method according to claim 1, wherein said modulated optical signals comprise at least one continuous signal pulse with amplitude greater than zero that is modulated in at least one of amplitude or frequency.

11. The method of claim 1, wherein transmitting modulated optical signals to said projectile comprises reflecting optical signals to said projectile from an intermediate surface between the fire control device and a target, said intermediate surface not comprising the target.

12. A method for optically programming an in-flight projectile fired from a fire control device comprising the steps of:

a) transmitting modulated optical signals to said projectile from a transmitter attached to said fire control device;

b) collecting said modulated optical signals by a collector disposed in a nose of said projectile, wherein said collector is made of translucent material;

c) receiving said modulated optical signals from said collector by a sensor disposed within said projectile, wherein said modulated optical signals activate said sensor; and d) modulating a fuze circuit by said activated sensor, wherein transmitting modulated optical signals to said projectile comprises transmitting modulated optical signals directly to said projectile.

13. The method according to claim 12, wherein said modulated optical signals are transmitted at particular beam width, strength and frequency.

14. The method according to claim 12, wherein said transmitter and said sensor function at discrete frequencies in one of the UV, visual and IR spectrums.

15. The method according to claim 12, wherein said modulated optical signals are modulated in at least one of amplitude or frequency.

16. The method according to claim 12, wherein said modulated optical signals comprise programming protocol including at least one of function mode or an optimum function time.

17. The method according to claim 12, wherein said projectile comprises translucent housing.

18. The method according to claim 17, wherein said translucent housing protects said sensor.

19. The method according to claim 12, wherein said collector collects direct and reflected modulated optical signals from said transmitter.

20. The method according to claim 12, wherein said collector refracts, reflects and focuses said modulated optical signal to said sensor.

21. The method according to claim 12, wherein said fuze circuit uses a logarithmic input to distinguish said modulated optical signals from other optical rays.

22. The method of claim 12, wherein transmitting modulated optical signals to said projectile comprises reflecting optical signals to said projectile from an intermediate surface between the fire control device and a target, said intermediate surface not comprising the target.

23. A system for optically programming an in-flight projectile fired from a fire control device, said system comprising:

a) a transmitter attached to said fire control device for transmitting modulated optical signals directly to said projectile;

b) a collector mounted on a nose of said projectile for collecting said modulated optical signals, wherein said collector is made of translucent material;

c) a sensor, disposed within said projectile for receiving said modulated optical signals from said collector, wherein said modulated optical signals activate said sensor; and d) a fuze circuit, wherein said fuze circuit is modulated by said activated sensor.

24. The system according to claim 23, wherein said transmitter and said sensor function at discrete frequencies in one of the UV, visual and IR spectrums.

25. The system according to claim 23, wherein said projectile comprises translucent housing.

26. The system according to claim 25, wherein said sensor is disposed in and protected by said housing.

27. The system according to claim 23, wherein said collector may be made of a translucent material that bends and separates.

28. The system according to claim 23, wherein said collector collects direct and reflected modulated optical signals from said transmitter.

29. The system according to claim 23, wherein said collector refracts, reflects and focuses said modulated optical signal to said sensor.

30. The system according to claim 23, wherein said fuze circuit uses a logarithmic input to distinguish said modulated optical signals from other optical rays.

31. A system for optically programming an in-flight projectile fired from a fire control device, said system comprising:

a) means for transmitting modulated optical signals to said projectile from a transmitter attached to said fire control device;

b) means for collecting said modulated optical signals by a collector mounted on a nose of said projectile;

c) means for receiving said modulated optical signals from said collector by a sensor disposed within said projectile, wherein said modulated optical signals activate said sensor; and d) means for modulating a fuze circuit by said activated sensor, wherein said means for transmitting modulated optical signals to said projectile comprises means for transmitting modulated optical signals directly to said projectile.

* * * * *